US007821324B2

(12) United States Patent
Han

(10) Patent No.: US 7,821,324 B2
(45) Date of Patent: Oct. 26, 2010

(54) REFERENCE CURRENT GENERATING CIRCUIT USING ON-CHIP CONSTANT RESISTOR

(75) Inventor: Dong Ok Han, Gyunggi-do (KR)

(73) Assignee: Samsung Electro-Mechanics, Co., Ltd, Gyunggi-do (KR)

( * ) Notice: Subject to any disclaimer, the term of this patent is extended or adjusted under 35 U.S.C. 154(b) by 47 days.

(21) Appl. No.: 12/325,097

(22) Filed: Nov. 28, 2008

(65) Prior Publication Data

US 2010/0045369 A1 Feb. 25, 2010

(30) Foreign Application Priority Data

Aug. 21, 2008 (KR) ..... 10-2008-0081880

(51) Int. Cl.
*G05F 1/10* (2006.01)

(52) U.S. Cl. ..... 327/535; 327/513

(58) Field of Classification Search ..... 327/512, 327/513, 534, 535, 537, 539
See application file for complete search history.

(56) References Cited

U.S. PATENT DOCUMENTS 5,434,533 A * 7/1995 Furutani ..... 327/538
6,211,661 B1 * 4/2001 Eckhardt ..... 323/316
6,348,832 B1 * 2/2002 Chih ..... 327/538
6,351,111 B1 * 2/2002 Laraia ..... 323/315
7,504,878 B2 * 3/2009 Lin ..... 327/540
7,616,050 B2 * 11/2009 Eckstein ..... 327/538

FOREIGN PATENT DOCUMENTS

KR 1998026260 A 7/1998
KR 100228354 B1 8/1999
KR 2000-17044 A 3/2000

OTHER PUBLICATIONS

Korean Office Action for application No. 10-2008-0081880, issued Jul. 24, 2010.

* cited by examiner

*Primary Examiner*—Jeffrey S Zweizig

(57) ABSTRACT

Provided is a reference current generating circuit capable of maintaining a constant output level regardless of a temperature variation by the use of a reference resistor having a constant resistance regardless of the temperature variation. The reference current generating circuit includes a reference voltage circuit supplying a reference voltage having a constant level regardless of a temperature variation, and a reference resistor circuit comprising a resistor having a positive temperature coefficient and a resistor having a negative temperature coefficient that are connected in series, the reference resistor circuit having a constant total resistance regardless of the temperature variation. Herein, a reference current having a constant level regardless of the temperature variation is generated by the reference voltage and the resistance of the reference resistor circuit.

15 Claims, 5 Drawing Sheets

REFERENCE CURRENT GENERATING CIRCUIT USING ON-CHIP CONSTANT RESISTOR

CROSS-REFERENCE TO RELATED APPLICATIONS

This application claims the priority of Korean Patent Application No. 2008-81880 filed on Aug. 21, 2008 in the Korean Intellectual Property Office, the disclosure of which is incorporated herein by reference.

BACKGROUND OF THE INVENTION

1. Field of the Invention

The present invention relates to a reference current generating circuit, and more particularly, to a reference current generating circuit having a constant output level regardless of a temperature variation.

2. Description of the Related Art

In general, a reference current generating circuit is built in most of integrated circuits for communication, and considered as a very important circuit used as a current source of an essential electronic circuitry.

Similarly to typical integrated circuits, a reference current generating circuit accompanies an output level fluctuation inevitably due to a variation in temperature and process. Unlike other circuits in the integrated circuit, however, a reference current variation may have an adverse effect on other circuits because the reference current generating circuit is used as a current source of other circuits. Therefore, the reference current generating circuit should be insensitive to the effects resulting from external conditions such as a temperature variation.

A related art reference current generating circuit generates a constant current by applying a reference voltage, which has a constant level regardless of a temperature variation, to a resistor. Here, the reference voltage is output from a constant voltage source (e.g., bandgap reference circuit) that generates a constant voltage regardless of the temperature variation. To generate a current having a constant level regardless of the temperature variation in the related art reference current generating circuit, it is very important to maintain the resistance of the resistor constantly. Meanwhile, a resistor integrated through CMOS process, for example, an n-well resistor or a polysilicon resistor, has a resistance that is very sensitively changed as a temperature varies. Accordingly, the related art reference current generating circuit cannot use the n-well resistor or the polysilicon resistor that is sensitive to the temperature variation, and thus employs an external resistor capable of adjusting the resistance to thereby generate the reference current. This makes it difficult to achieve a high integration of a circuitry after all.

SUMMARY OF THE INVENTION

An aspect of the present invention provides a reference current generating circuit including a reference resistor which has a constant resistance regardless of a temperature variation and also can be integrated.

According to an aspect of the present invention, there is provided a reference current generating circuit including: a reference voltage circuit supplying a reference voltage having a constant level regardless of a temperature variation; and a reference resistor circuit including a resistor having a positive temperature coefficient and a resistor having a negative temperature coefficient that are connected in series, the reference resistor circuit having a constant total resistance regardless of the temperature variation, wherein a reference current having a constant level regardless of the temperature variation is generated by the reference voltage and the resistance of the reference resistor circuit.

The reference resistor circuit may include: an NMOS resistor including a diode-connected N-channel MOSFET; and a PMOS resistor including a P-channel MOSFET, and connected to the NMOS resistor in series.

The reference resistor circuit may include an n-well resistor and an NMOS resistor including a diode-connected N-channel MOSFET.

The reference resistor circuit may include an n-well resistor and an NMOS resistor including a diode-connected N-channel MOSFET.

The reference resistor circuit may include an n-well resistor and a PMOS resistor including a diode-connected P-channel MOSFET.

The reference resistor circuit may include an NMOS resistor including a diode-connected N-channel MOSFET, and a polysilicon resistor.

The reference resistor circuit may include a PMOS resistor including a diode-connected P-channel MOSFET, and a polysilicon resistor.

The NMOS resistor may include a plurality of diode-connected N-channel MOSFETs which are connected in parallel through a switch.

The PMOS resistor may include a plurality of diode-connected P-channel MOSFETs which are connected in parallel through a switch.

The reference current generating circuit may further include a current mirror circuit generating a mirror current corresponding to the reference current to output the mirror current to an outside.

The reference voltage circuit may include an operational amplifier where a voltage having a constant level regardless of a temperature variation is received from an external source through an inverting terminal, and a non-inverting terminal is connected to one end of the reference resistor circuit.

The current mirror circuit may include: a first P-channel MOSFET including a gate connected to an output terminal of the operational amplifier, a source connected to a power supply voltage terminal, and a drain connected to one end of the reference resistor circuit connected to the non-inverting terminal of the operational amplifier; and a second P-channel MOSFET including a gate connected to the output terminal of the operational amplifier, a source connected to the power supply voltage terminal, and a drain through which the mirror current corresponding to the reference current is output.

The reference current generating circuit may further include a stabilization circuit that includes: a first capacitor connected to a power supply voltage terminal and an output terminal of the operational amplifier; and a resistor and a second capacitor connected in series between the output terminal of the operational amplifier and the non-inverting terminal of the operational amplifier.

The reference voltage circuit may include: a first N-channel MOSFET receiving a voltage having a constant level regardless of a temperature variation from an external source through a gate thereof; a second N-channel MOSFET including a source connected to a source of the first N-channel MOSFET, and a gate connected to one end of the reference resistor circuit; a third P-channel MOSFET including a drain connected to a drain of the first N-channel MOSFET, and a source to which a power supply voltage is applied; and a fourth P-channel MOSFET including a gate and a drain connected to a gate of the third P-channel MOSFET, a source to which the power supply voltage is applied, and the drain connected to a drain of the second N-channel MOSFET, wherein the first and second N-channel MOSFETs, which are commonly connected, have a differential amplification circuit configuration connected to a ground.

The reference resistor circuit may further include an output resistor between the drain of the first N-channel MOSFET and the drain of the third P-channel MOSFET.

The current mirror circuit may include: a fifth P-channel MOSFET including a gate connected to a connection node between the drain of the third P-channel MOSFET and the output resistor, and a source connected to a power supply voltage terminal;

a sixth P-channel MOSFET including a gate connected to a gate of the fifth P-channel MOSFET, and a source connected to the power supply voltage terminal; a seventh P-channel MOSFET including a gate connected to a connection node between the drain of the first N-channel MOSFET and the output resistor, a source connected to a drain of the fifth P-channel MOSFET, and a drain connected to the gate of the second N-channel MOSFET; and an eighth P-channel MOSFET including a gate connected to a gate of the seventh P-channel MOSFET, a source connected to a drain of the sixth P-channel, and a drain through which the mirror current corresponding to the reference current is output.

The reference current generating circuit of claim 13 may further include a power control circuit that includes: a ninth P-channel MOSFET including a gate receiving a control signal, and a drain connected to the drain of the third P-channel MOSFET; and a tenth P-channel MOSFET including a gate receiving the control signal, a source through which the power supply voltage is applied, and a drain connected to the drain of the fourth P-channel MOSFET, wherein the power control circuit determines activation/deactivation of an operation according to a logic level of the control signal.

The current mirror circuit may include: an eleventh P-channel MOSFET including a gate connected to the drain of the first N-channel MOSFET, a source connected to a power supply voltage terminal, and a drain connected to the gate of the second N-channel MOSFET; and a twelfth P-channel MOSFET including a gate connected to a gate of the eleventh P-channel MOSFET, a source connected to the power supply voltage terminal, and a drain through which the mirror current corresponding to the reference current is output.

The reference current generating circuit may further include a stabilization circuit that includes: a first capacitor connected between a power supply voltage terminal and the drain of the first N-channel MOSFET; and a resistor and a second capacitor connected in series between the drain of the first N-channel MOSFET and the gate of the second N-channel MOSFET.

BRIEF DESCRIPTION OF THE DRAWINGS

The above and other aspects, features and other advantages of the present invention will be more clearly understood from the following detailed description taken in conjunction with the accompanying drawings, in which.

DETAILED DESCRIPTION OF THE PREFERRED EMBODIMENT

Figure 1:
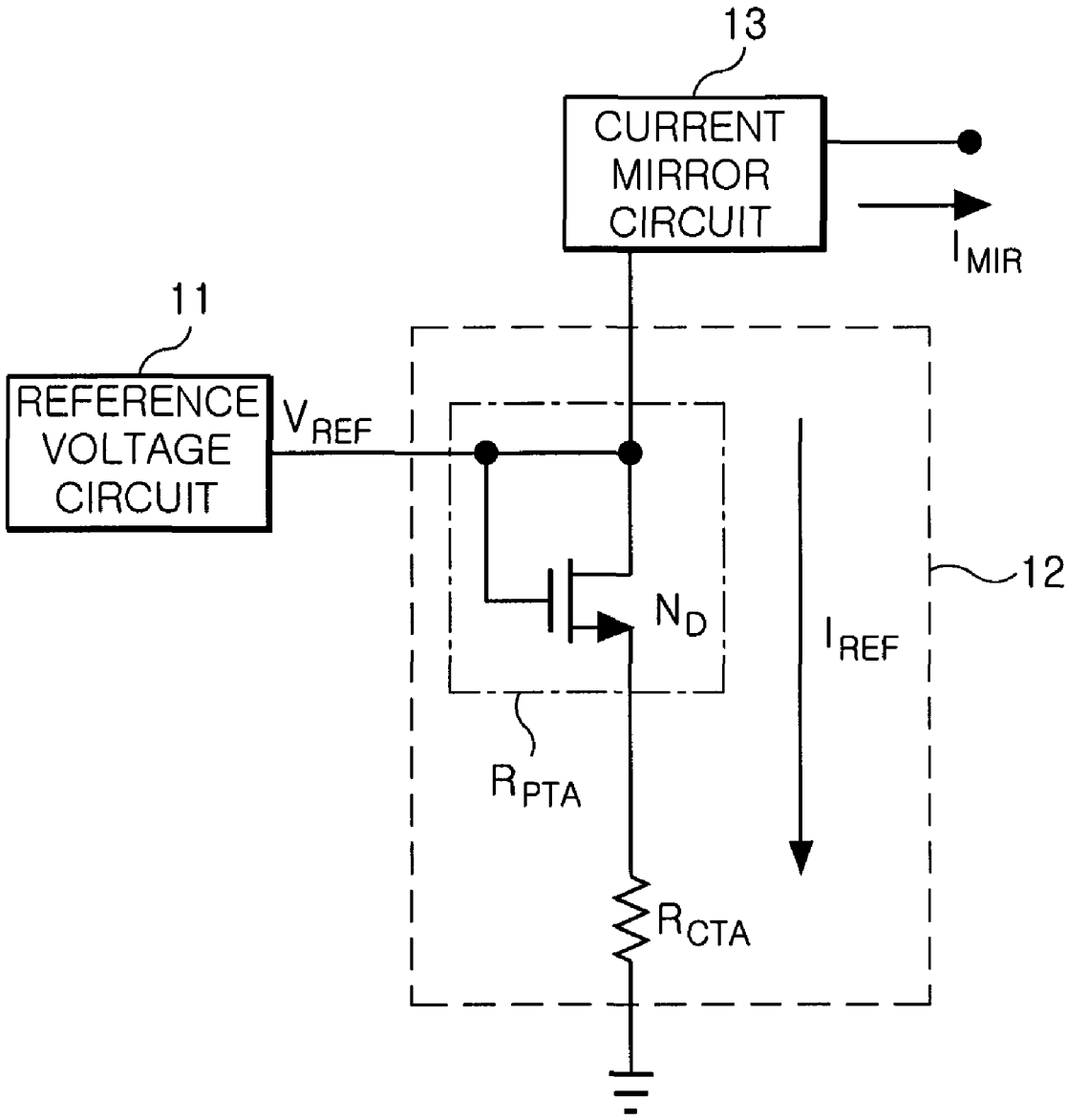
FIG. 1 is a block diagram of a reference current generating circuit according to an embodiment of the present invention.

Exemplary embodiments of the present invention will now be described in detail with reference to the accompanying drawings. The invention may, however, be embodied in many different forms and should not be construed as being limited to the embodiments set forth herein; rather, these embodiments are provided so that this disclosure will be thorough and complete, and will fully convey the concept of the invention to those skilled in the art. In the drawings, therefore, the thicknesses of layers and regions are exaggerated for clarity.

FIG. 1 is a block diagram of a reference current generating circuit according to an embodiment of the present invention.

Referring to FIG. 1, a reference current generating circuit according to the embodiment of the present invention includes a reference voltage circuit 11 applying a reference voltage $V_{REF}$ having a constant level regardless of a temperature variation, and a reference resistor circuit 12 having two resistors $R_{PTA}$ and $R_{CTA}$ of which temperature coefficients differ from each other.

In the reference current generating circuit having the above configuration, a reference current $I_{REF}$ flowing to the other end of the reference resistor circuit 12 is generated when the reference voltage $V_{REF}$ is applied to one end of the reference resistor circuit 12.

Furthermore, the reference current generating circuit according to the embodiment of the present invention may further include a current mirror circuit 13 that generates a mirror current $I_{MIR}$ corresponding to the reference current $I_{REF}$ and outputs the mirror current $I_{MIR}$ to the outside.

The reference voltage circuit 11 is a circuit of using an input voltage having a constant level regardless of a temperature variation, which is generated from well-known constant voltage generating circuits such as a bandgap reference circuit. The reference voltage circuit 11 functions to transform an impedance so as not to affect characteristics of the constant voltage generation circuit outputting the input voltage. For example, the reference voltage circuit 11 may be configured with an operational amplifier (OP AMP) or a circuit performing a function corresponding to the operational amplifier.

The reference resistor circuit 12 may include resistors having different temperature coefficients that are connected to each other in series. For convenience in description, a resistor having a positive temperature coefficient that its resistance progressively increases as a surrounding temperature increases is called a first resistor $R_{PTA}$; and a resistor having a negative temperature coefficient that its resistance progressively decreases as a surrounding temperature increases is called a second resistor $R_{CTA}$.

In typical CMOS process for fabricating an integrated circuit, an on-chip resistor may be realized in various forms such as an n-well resistor, a polysilicon resistor, or a MOS resistor. Here, the MOS resistor is a diode-connected MOSFET where a gate and a drain are connected to each other. However, an on-chip resistor fabricated through the CMOS process has a large resistance variation according to a temperature variation. For example, the n-well resistor may have a positive temperature coefficient that its resistance increases as the temperature increases; the polysilicon resistor may have a negative temperature coefficient that its resistance decreases as the temperature increases; and the MOS resistor may have a positive or negative temperature coefficient depending on a voltage level between a drain and a gate thereof. Therefore, in case where the typical on-chip resistors are used as a resistor for generating a reference current, it is impossible to generate a current having a constant level regardless of a temperature variation because the reference current generated by the reference voltage and the on-chip resistance increases or decreases depending on a temperature although the reference voltage applied to one end of this on-chip resistor is constant regardless of the temperature variation.

To solve the above-described problem, the present invention employs two on-chip resistors having different temperature coefficients connected in series so that resistances of the two on-chip resistors are offset each other because the resistance variation of one on-chip resistor is contrary to the resistance variation of the other one. Consequently, the total resistance of the reference resistor circuit 12 can be maintained constantly regardless of the temperature variation.

The reference resistor circuit 12 may be embodied by a following combination of on-chip resistors.

As illustrated in FIG. 1, the reference resistor circuit 12 may include an NMOS resistor including a diode-connected N-channel MOSFET $N_D$, and a polysilicon resistor. The NMOS resistor including the N-channel MOSFET $N_D$ can be used as the first resistor $R_{PTA}$ having a positive temperature coefficient that its resistance increases as the temperature increases, whereas the polysilicon resistor can be used as the second resistor $R_{CTA}$ having a negative temperature coefficient that its resistance decreases as the temperature increases.

The NMOS resistor configured with the diode-connected N-channel MOSFET $N_D$ has such a characteristic that its temperature coefficient varies with the magnitude of a voltage applied between both terminals, i.e., a drain and a source of the diode-connected N-channel MOSFET $N_D$. When a voltage having a level higher than a specific voltage level is applied between the drain and the source of the diode-connected N-channel MOSFET $N_D$, the NMOS resistor has the positive temperature coefficient. On the contrary, when a voltage having a level lower than the specific voltage level is applied between the drain and the source of the diode-connected N-channel MOSFET $N_D$, the NMOS resistor has the negative temperature coefficient.

As illustrated in FIG. 1, the reference resistor circuit 12 of the present invention sets a voltage applied between both terminals of the NMOS resistor such that the NMOS resistor has the positive temperature coefficient, and may employ a polysilicon resistor having a negative temperature coefficient as the second resistor $R_{CTA}$.

As another combination of on-chip resistors, the reference resistor circuit 12 may include a PMOS resistor including a diode-connected P-channel MOSFET, and a polysilicon resistor. Similarly to the aforesaid diode-connected N-channel MOSFET, the diode-connected P-channel MOSFET has a positive or negative temperature coefficient depending on the magnitude of a voltage applied between a drain and a source thereof. Therefore, the reference resistor circuit 12 sets a voltage applied between both terminals of the PMOS resistor such that the PMOS resistor has the positive temperature coefficient, and may employ a polysilicon resistor having a negative temperature coefficient as the second resistor $R_{CTA}$.

As still another combination of on-chip resistors, the reference resistor circuit 12 may include an n-well resistor and an NMOS resistor including a diode-connected N-channel MOSFET. It is known that the n-well resistor has a positive temperature coefficient that its resistance increases as the temperature increases generally. In such a combination of the on-chip resistors, temperature coefficients of the n-well resistor and the NMOS resistor are offset each other by appropriately adjusting the magnitude of the voltage applied between both terminals of the NMOS resistor such that the NMOS resistor has a negative temperature coefficient. Resultantly, the reference resistor circuit 12 can have a constant resistance regardless of a temperature variation. As described above, since the diode-connected N-channel MOSFET and the diode-connected P-channel MOSFET has temperature coefficients similar to each other, the reference resistor circuit 12 may be configured with an n-well resistor and a PMOS resistor including a diode-connected P-channel MOSFET.

As yet another combination of on-chip resistors, the reference resistor circuit 12 may include an NMOS resistor including a diode-connected N-channel MOSFET and a PMOS resistor including a diode-connected P-channel MOSFET. In this combination, a voltage applied between both terminals of the N-channel MOSFET should be adjusted in order for the N-channel MOSFET to have a positive temperature coefficient, and a voltage applied between both terminals of the P-channel MOSFET should be adjusted in order for the P-channel MOSFET to have a negative temperature coefficient. For example, the resistance of the NMOS resistor should be adjusted such that a voltage higher than a reference voltage is applied between both terminals of the NMOS resistor in order for the NMOS transistor to have a positive temperature coefficient. Likewise, the resistance of the PMOS resistor should be adjusted such that a voltage lower than a reference voltage is applied between both terminals of the PMOS resistor in order for the PMOS transistor to have a negative temperature coefficient.

Figure 2:
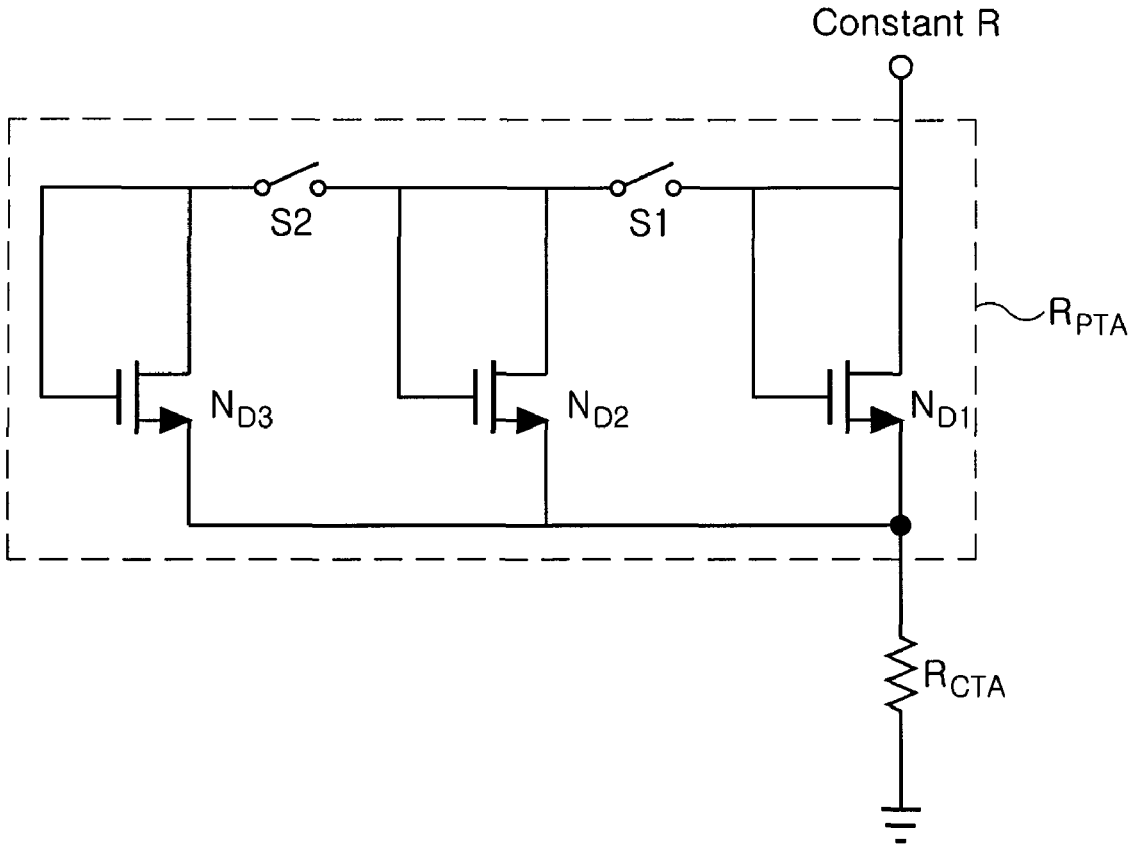
FIG. 2 is a circuit diagram illustrating an example of a first resistor according to an embodiment of the present invention.

In case where the reference resistor circuit 12 employs the NMOS resistor, the NMOS resistor may include a plurality of diode-connected N-channel MOSFETs, which will be illustrated in FIG. 2 in detail. Referring to FIG. 2, the NMOS resistor may include a plurality of diode-connected N-channel MOSFETs $N_{D1}$ to $N_{D3}$, and switches S1 and S2 disposed between the respective N-channel MOSFETs $N_{D1}$ to $N_{D3}$. The switches S1 and S2 are respectively provided between drains of the diode-connected N-channel MOSFETs $N_{D1}$ to $N_{D3}$, and sources of the diode-connected N-channel MOSFETs $N_{D1}$ to $N_{D3}$ may be commonly connected. The resistance of the NMOS resistor $R_{PTA}$ illustrated in FIG. 2 can be varied by adjusting a resistance range of the NMOS resistor $R_{PTA}$ through ON/OFF states of the switches. The NMOS resistor $R_{PTA}$ having the configuration illustrated in FIG. 2 can adjust an appropriate resistance through ON/OFF states of the switches S1 and S2 if it is necessary to adjust the resistance due to an error of a bandgap reference circuit applying the reference voltage and an unexpected process error.

Although not shown, the PMOS resistor may have the same configuration as the NMOS resistor illustrated in FIG. 2. That is, the PMOS resistor may include a plurality of diode-connected P-channel MOSFETs and switches disposed between the respective P-channel MOSFETs. The switches S1 and S2 are respectively provided between drains of the diode-connected P-channel MOSFETs, and sources of the diode-connected N-channel MOSFETs $N_{D1}$ to $N_{D3}$ may be commonly connected. The resistance of the PMOS resistor can appropriately adjusted through ON/OFF states of the switches.

As described above, the reference current generating circuit of the present invention employs a reference resistor that can not only realize a high integration using CMOS process but can also maintain a constant resistance regardless of a temperature variation, thus making it possible to generate a reference current having a constant output level regardless of a temperature variation.

Figure 3A:
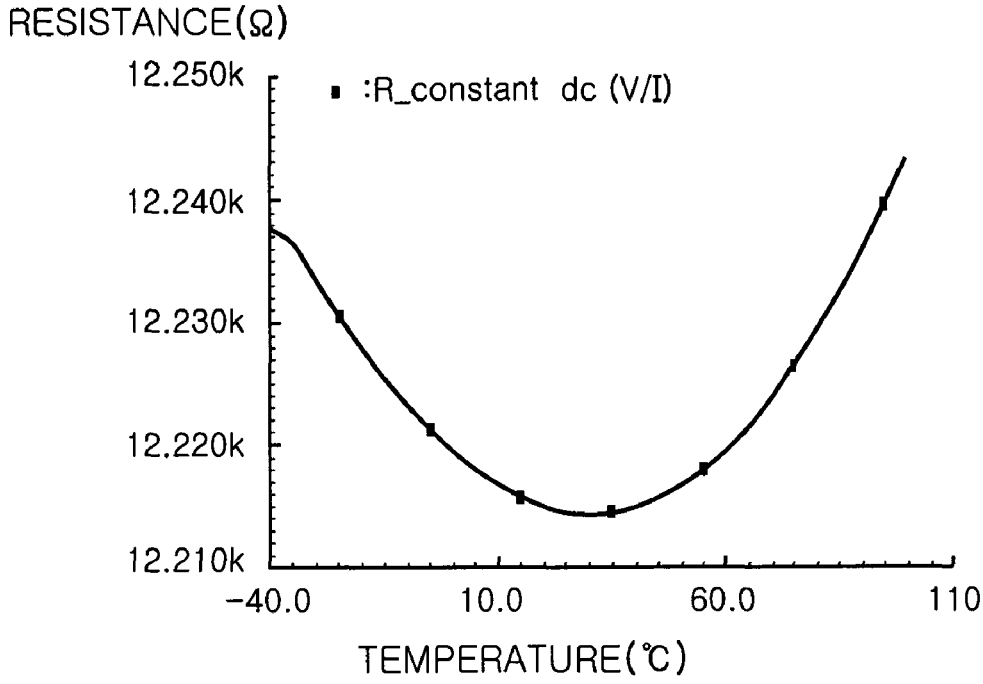
FIG. 3A is a graph showing a resistance variation versus a temperature in a reference resistor circuit according to an embodiment of the present invention.
Figure 3B:
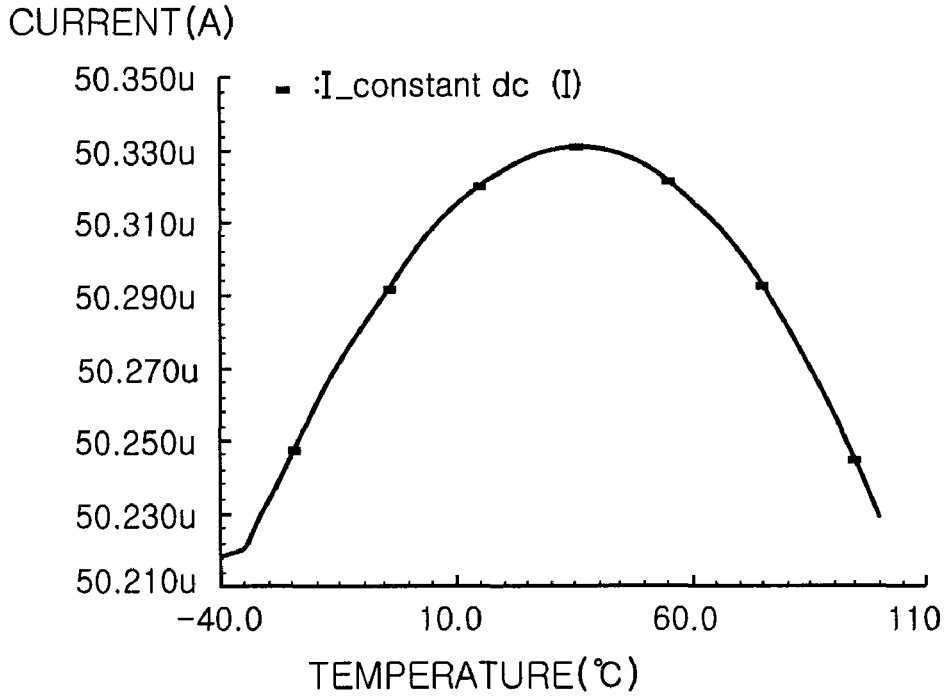
FIG. 3B is a graph showing a current variation versus a temperature in a reference resistor circuit according to an embodiment of the present invention.

FIG. 3A is a graph showing a resistance variation versus a temperature in a reference resistor circuit according to an embodiment of the present invention, and FIG. 3B is a graph showing a current variation versus a temperature in a reference resistor circuit according to an embodiment of the present invention.

As illustrated in FIG. 3A, since the first resistor $R_{PTA}$ having a positive temperature coefficient and the second resistor $R_{CTA}$ having a negative temperature coefficient are connected to each other in series, a resistance difference between the minimum resistance and the maximum resistance is merely about 0.25% (17.4 ppm/° C.) while the surrounding temperature varies from about −40° C. to about 100° C. It is deemed that the resistance is almost maintained constantly regardless of the temperature variation. Likewise, according to the resistance variation of the reference resistor circuit illustrated in FIG. 3A, the reference current is also maintained constantly regardless of the temperature variation, as illustrated in FIG. 3B. That is, it can be observed that a reference current difference between the maximum current and the minimum current is maintained to a constant level, i.e., about 0.22% (15.5 ppm/° C.), while the surrounding temperature varies from about −40° C. to about 100° C.

The current mirror circuit 13 generates a mirror current $I_{MIR}$ corresponding to the reference current $I_{REF}$ to supply the reference current $I_{REF}$ flowing through the reference resistor circuit 12 to other external devices. It is impossible to directly supply the reference current $I_{REF}$ flowing through the reference resistor circuit 12 to external devices requiring the reference current. Therefore, it is required an apparatus for supplying the reference current, which is generated by the reference voltage and the resistance of the reference resistor circuit 12, to the external devices. To this end, the reference current generating circuit in accordance with the present invention may further include the current mirror circuit 13 that mirrors and outputs the current flowing through the reference resistor circuit 12 so as to supply the current having the same magnitude with the reference current while not affecting the magnitude of the reference current. The current mirror circuit 13 may employ various types of current mirror circuits that are well known in the art to which the present invention pertains.

Figure 4:
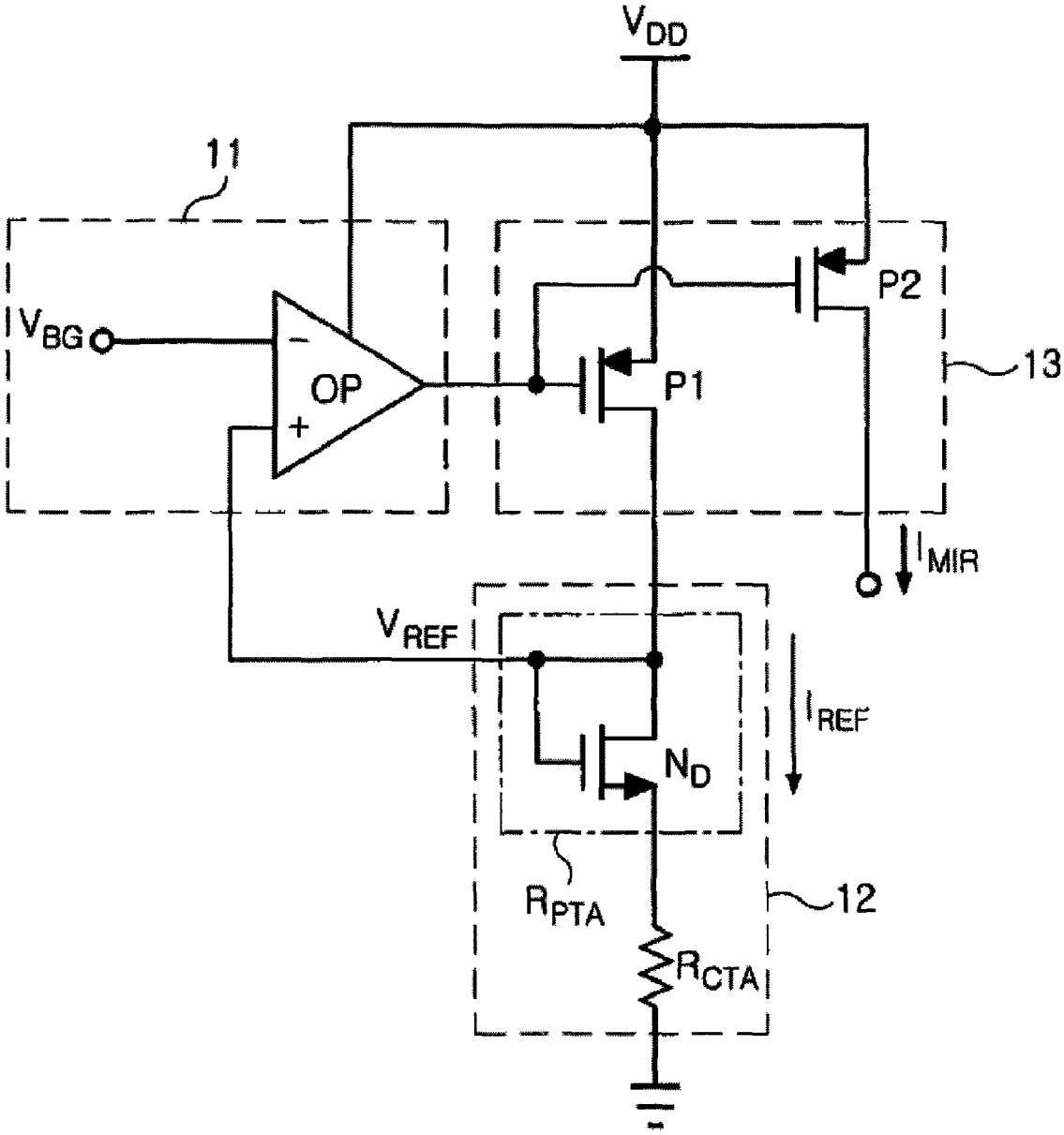
FIG. 4 is a circuit diagram illustrating a reference current generating circuit according to another embodiment of the present invention.

FIG. 4 is a circuit diagram illustrating a reference current generating circuit according to another embodiment of the present invention.

The reference current generating circuit, which is illustrated in FIG. 4, may include a reference voltage circuit 11 having an operational amplifier OP. That is, in the embodiment of FIG. 4, the operational amplifier OP included in the reference voltage circuit 11 may be configured with an inverting terminal receiving a voltage $V_{BG}$ having a constant level regardless of a temperature variation from a constant voltage source such as an external bandgap reference circuit, and a non-inverting terminal connected to one end of the reference resistor circuit 12. It is noted that the inverting terminal and the non-inverting terminal have the same potential level in an ideal operational amplifier OP. Therefore, the reference voltage circuit 11 illustrated in FIG. 4 can output the voltage $V_{BG}$, which has a constant level regardless of the temperature variation and input from an external source, to the reference resistor circuit 12 as a reference voltage $V_{REF}$. Herein, the operational amplifier OP can serve as an impedance transformation circuit that sets impedance seen from a node, to which the reference voltage $V_{REF}$ is applied, toward an external constant voltage source to infinity. In other words, the operational amplifier OP functions to adjust the impedance such that the external constant voltage source is not affected by circuits connected to the node to which the reference voltage $V_{REF}$ is applied.

In this embodiment, the current mirror circuit 13 may include a first P-channel MOSFET P1 and a second P-channel MOSFET P2. The first P-channel MOSFET P1 includes a gate connected to an output terminal of the operational amplifier OP, a source connected to a power supply voltage ($V_{DD}$) terminal, and a drain connected to one end of the reference resistor circuit 12 connected to the non-inverting terminal of the operational amplifier OP. The second P-channel MOSFET P2 includes a gate connected to the output terminal of the operational amplifier OP, a source connected to the $V_{DD}$ terminal, and a drain through which a mirror current $I_{MIR}$ corresponding to the reference current $I_{REF}$.

Figure 5:
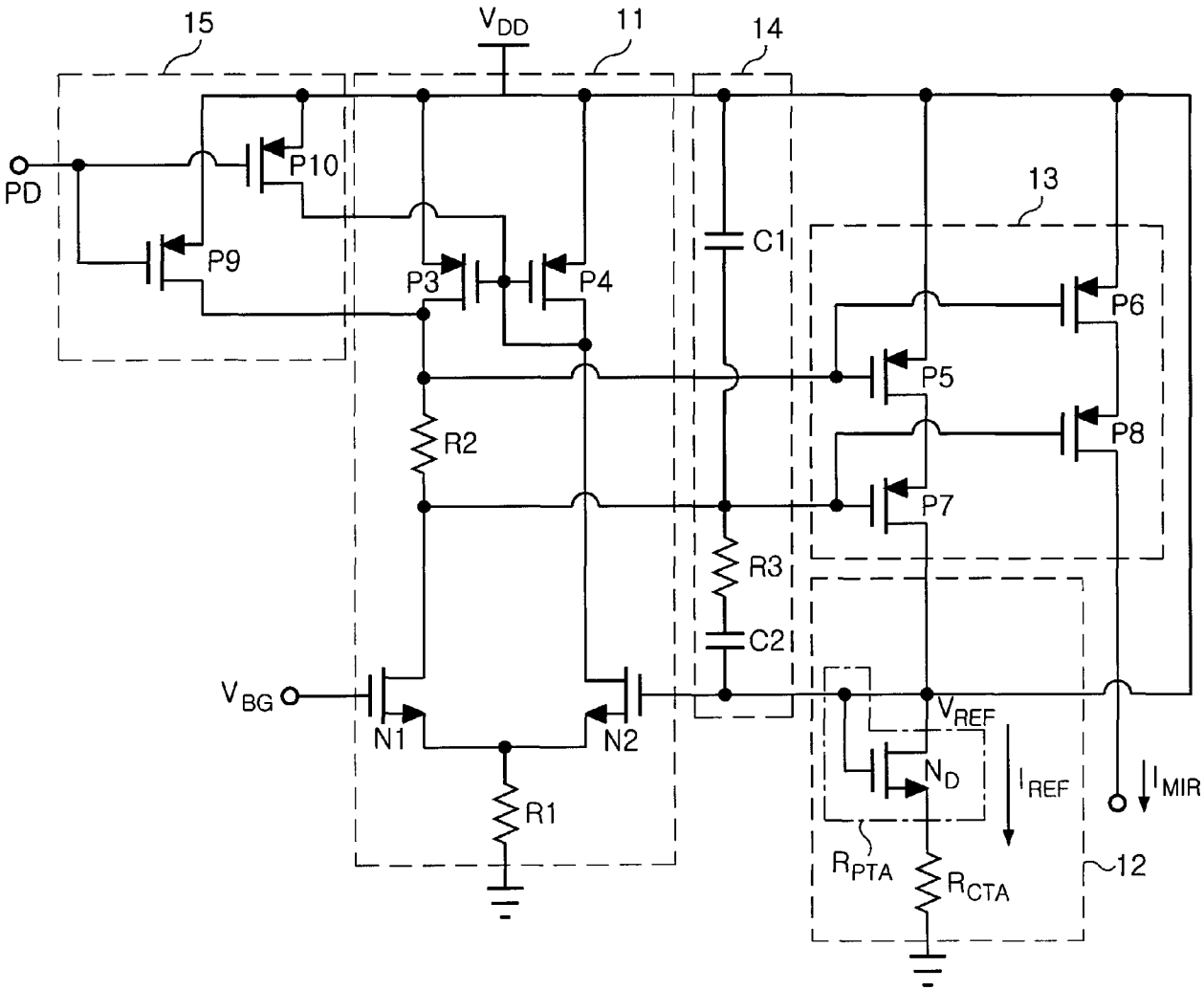
FIG. 5 is a circuit diagram illustrating a reference current generating circuit according to still another embodiment of the present invention.

FIG. 5 is a circuit diagram illustrating a reference current generating circuit according to still another embodiment of the present invention.

In a reference voltage circuit 11 of the reference current generating circuit of FIG. 5, a circuit corresponding to the operational amplifier OP in FIG. 4 is implemented with MOSFETs. The reference voltage circuit 11 in FIG. 5 includes a first N-channel MOSFET N1, a second N-channel MOSFET N2, a third P-channel MOSFET P3, and a fourth P-channel MOSFET P4. The first N-channel MOSFET N1 receives a voltage $V_{BG}$ having a constant level regardless of a temperature variation from an external source through a gate thereof. In the second N-channel MOSFET N2, a source is connected to a source of the first N-channel MOSFET N1, and a gate is connected to one end of the reference resistor circuit 12. In the third P-channel MOSFET P3, a drain is connected to a drain of the first N-channel MOSFET N1, and a power supply voltage $V_{DD}$ is applied to a source. In the fourth P-channel MOSFET P4, a gate and a drain are connected to a gate of the third P-channel MOSFET P3, the power supply voltage $V_{DD}$ is applied to a source, and the drain is connected to the drain of the second N-channel MOSFET N2. The reference voltage circuit 11 may have a differential amplification circuit configuration where the source of the first N-channel MOSFET N1 and the source of the second N-channel MOSFET N2, which are commonly connected, are connected to a ground through a resistor R1.

It can be easily understood by those skilled in the art that the reference voltage circuit 11 in FIG. 5 is very similar in circuit configuration to the operational amplifier OP in FIG. 4. Also, it can be easily understood by those skilled in the art that the reference voltage circuit 11 in FIG. 5 can serve as an impedance transformation circuit for preventing the external constant voltage source applying the voltage $V_{BG}$ having a constant level regardless of a temperature variation from being affected, which is similar to the operational amplifier OP in FIG. 4.

The reference voltage circuit 11 in FIG. 5 may further include an output resistor R2 between the drain of the third P-channel MOSFET P3 and the drain of the first N-channel MOSFET N1 corresponding to an output terminal of a differential amplification circuit. This output resistor R2 may be provided to increase a resistance seen from an external circuit connected thereto.

As such, in case where the output resistor R2 is provided in the reference voltage circuit 11, the current mirror circuit 13 may include a fifth P-channel MOSFET P5, a sixth P-channel MOSFET P6, a seventh P-channel MOSFET P7, and an eighth P-channel MOSFET P8. In the fifth P-channel MOSFET P5, a gate is connected to a connection node between the drain of the third P-channel MOSFET P3 and the output resistor R2, and a source is connected to the $V_{DD}$ terminal. In the sixth P-channel MOSFET P6, a gate is connected to the gate of the fifth P-channel MOSFET P5, and a source is connected to the $V_{DD}$ terminal. In the seventh P-channel MOSFET P7, a gate is connected to a connection node between the drain of the first N-channel MOSFET N1 and the output resistor R2, a source is connected to the drain of the fifth P-channel MOSFET P5, and a drain is connected to the gate of the second N-channel MOSFET N2. In the eighth P-channel MOSFET P8, a gate is connected to the gate of the seventh P-channel MOSFET P7, a source is connected to the drain of the sixth P-channel MOSFET P6, and a mirror current $I_{MIR}$ corresponding to the reference current $I_{REF}$ is output through a drain.

The mirror current circuit 13 illustrated in FIG. 5 may include two current mirror circuits of which one is provided with the fifth P-channel MOSFET P5 and the sixth P-channel MOSFET, and the other is provided with the seventh P-channel MOSFET P7 and the eight P-channel MOSFET P8. Therefore, in the embodiment of FIG. 5, a current-mirroring can be more stably performed by virtue of the two current mirror circuits, which makes it possible to more stably supply the mirror current $I_{MIR}$ corresponding to the reference current to an external circuit.

Of course, as a modification of the embodiment of FIG. 5, the current mirror circuit 13 including only one current mirror circuit is also applicable to the present invention. That is, in the modification of the embodiment of FIG. 5, the fifth and sixth MOSFETs P5 and P6 are removed from the current mirror circuit 13 in FIG. 5, and the source of each of the seventh and eighth P-channel MOSFETs P7 and P8 is directly connected to the $V_{DD}$ terminal. Likewise, in another modification of the present invention, the seventh and eight P-channel MOSFETs P7 and P8 are removed, the drain of the fifth P-channel MOSFET p5 is connected to the gate of the second N-channel MOSFET N2, and the mirror current $I_{MIR}$ corresponding to the reference current is output through the drain of the sixth P-channel MOSFET P6.

In the embodiment of the present invention illustrated in FIG. 5, a stabilization circuit 14 may be further provided to stabilize the reference current $I_{REF}$ The stabilization circuit 14 includes a capacitor C1 connected between the $V_{DD}$ terminal and the drain of the first N-channel MOSFET N1, and a capacitor C2 and a resistor R3 connected in series between the drain of the first N-channel MOSFET N1 and the gate of the second N-channel MOSFET N2. In the stabilization circuit 14, the series-connected capacitor C2 and the resistor R3 between the drain of the first N-channel MOSFET N1 and the gate of the second N-channel MOSFET N2 serve as a negative feedback circuit for the reference voltage circuit 11. In the negative feedback circuit, the capacitance of the capacitor C2 increases due to capacitance amplification according to the Miller effect, and a high capacitance can be obtained in spite of low capacitance of the capacitor in the negative feedback circuit. However, frequency stability may be deteriorated due to zero resulting from the feedfoward effect. To achieve good frequency stability, therefore, the resistor R3 is connected to the capacitor C2 in series to thereby remove the zero. That is, the feedback circuit of the series-connected capacitor C2 and resistor R3 functions as the stabilization circuit 14 of the reference current generating circuit.

The stabilization circuit 14 is also applicable to the embodiment of FIG. 4. To be specific, the reference current generating circuit of FIG. 4 employing the operational amplifier OP may further include a stabilization circuit provided with a capacitor connected between the $V_{DD}$ terminal and the output terminal of the operational amplifier OP, and a series-connected capacitor and resistor between the output terminal of the operational amplifier OP and the non-inverting terminal.

In addition, the reference current generating circuit of FIG. 5 may further include a power control circuit 15 determining activation/deactivation of overall circuit operations according to a logic level of a control signal PD input from the outside. The power control circuit 15 includes a ninth P-channel MOSFET P9, and a tenth P-channel MOSFET P10. The ninth P-channel MOSFET P9 includes a gate receiving the control signal PD, a source connected to the $V_{DD}$ terminal, and a drain connected to the drain of the third P-channel MOSFET P3. The tenth P-channel MOSFET P10 includes a gate receiving the control signal PD, a source connected to the $V_{DD}$ terminal, and a drain connected to the drain of the fourth P-channel MOSFET P4. When the control signal of logic low level, e.g., 0 V, is applied, the ninth and tenth P-channel MOSFETs P9 and P10 are turned on so that the power supply voltage $V_{DD}$ is applied all of the drain, gate and source of the third P-channel MOSFET. Resultantly, the third and fourth P-channel MOSFETs are not turned on, and thus the reference voltage circuit 11 does not operate. In contrast, when the control signal PD of logic high level, e.g., $V_{DD}$, is applied, the ninth and tenth P-channel MOSFETs P9 and P10 are turned off so that a circuit path of the ninth and tenth P-channel MOSFETs P9 and P10 is opened. Accordingly, the reference voltage circuit 11 operates in the same way as the circuit not having the ninth and tenth P-channel MOSFETs P9 and P10.

According to a reference current generating circuit in accordance with the present invention, it is possible to realize a high degree of integration and also generate a reference current having a constant level regardless of a temperature variation by employing a reference resistor circuit where two resistors which can be integrated and have different resistance variations according to a temperature variation are connected to each other in series. In addition, the reference resistor circuit may be configured such that a plurality of diode-connected MOSFETs are selectively used by switching them, thus allowing a resistance of the reference resistor circuit to be adjusted.

While the present invention has been shown and described in connection with the exemplary embodiments, it will be apparent to those skilled in the art that modifications and variations can be made without departing from the spirit and scope of the invention as defined by the appended claims.

What is claimed is:

1. A reference current generating circuit comprising:

a reference voltage circuit supplying a reference voltage having a constant level regardless of a temperature variation;

a reference resistor circuit comprising a resistor having a positive temperature coefficient and a resistor having a negative temperature coefficient that are connected in series, the reference resistor circuit having a constant total resistance regardless of the temperature variation; and a current mirror circuit generating a mirror current corresponding to a reference current to output the mirror current to an outside, wherein the reference current having a constant level regardless of the temperature variation is generated by the reference voltage and the resistance of the reference resistor circuit, wherein the reference voltage circuit comprises an operational amplifier where a voltage having a constant level regardless of a temperature variation is received from an external source through an inverting terminal, and a non-inverting terminal is connected to one end of the reference resistor circuit, wherein the current mirror circuit comprises:

a first P-channel MOSFET comprising a gate connected to an output terminal of the operational amplifier, a source connected to a power supply voltage terminal, and a drain connected to one end of the reference resistor circuit connected to the non-inverting terminal of the operational amplifier; and a second P-channel MOSFET comprising a gate connected to the output terminal of the operational amplifier, a source connected to the power supply voltage terminal, and a drain through which the mirror current corresponding to the reference current is output.

2. The circuit of claim 1, wherein the reference resistor circuit comprises:

an NMOS resistor comprising a diode-connected N-channel MOSFET; and a PMOS resistor comprising a P-channel MOSFET, and connected to the NMOS resistor in series.

3. The circuit of claim 1, wherein the reference resistor circuit comprises an n-well resistor and an NMOS resistor comprising a diode-connected N-channel MOSFET.

4. The circuit of claim 1, wherein the reference resistor circuit comprises an n-well resistor and a PMOS resistor comprising a diode-connected P-channel MOSFET.

5. The circuit of claim 1, wherein the reference resistor circuit comprises an NMOS resistor comprising a diode-connected N-channel MOSFET, and a polysilicon resistor.

6. The circuit of claim 1, wherein the reference resistor circuit comprises a PMOS resistor comprising a diode-connected P-channel MOSFET, and a polysilicon resistor.

7. The circuit of claim 2, wherein the NMOS resistor comprises a plurality of diode-connected N-channel MOSFETs which are connected in parallel through a switch.

8. The circuit of claim 2, wherein the PMOS resistor comprises a plurality of diode-connected P-channel MOSFETs which are connected in parallel through a switch.

9. A reference current generating circuit comprising:

a reference voltage circuit supplying a reference voltage having a constant level regardless of a temperature variation;

a reference resistor circuit comprising a resistor having a positive temperature coefficient and a resistor having a negative temperature coefficient that are connected in series, the reference resistor circuit having a constant total resistance regardless of the temperature variation;

a current mirror circuit generating a mirror current corresponding to a reference current to output the mirror current to an outside; and a stabilization circuit that comprises:

a first capacitor connected to a power supply voltage terminal and an output terminal of the operational amplifier; and a resistor and a second capacitor connected in series between the output terminal of the operational amplifier and the non-inverting terminal of the operational amplifier, wherein the reference current having a constant level regardless of the temperature variation is generated by the reference voltage and the resistance of the reference resistor circuit.

10. A reference current generating circuit comprising:

a reference voltage circuit supplying a reference voltage having a constant level regardless of a temperature variation;

a reference resistor circuit comprising a resistor having a positive temperature coefficient and a resistor having a negative temperature coefficient that are connected in series, the reference resistor circuit having a constant total resistance regardless of the temperature variation; and a current mirror circuit generating a mirror current corresponding to a reference current to output the mirror current to an outside, wherein the reference current having a constant level regardless of the temperature variation is generated by the reference voltage and the resistance of the reference resistor circuit, wherein the reference voltage circuit comprises:

a first N-channel MOSFET receiving a voltage having a constant level regardless of a temperature variation from an external source through a gate thereof;

a second N-channel MOSFET comprising a source connected to a source of the first N-channel MOSFET, and a gate connected to one end of the reference resistor circuit;

a third P-channel MOSFET comprising a drain connected to a drain of the first N-channel MOSFET, and a source to which a power supply voltage is applied; and a fourth P-channel MOSFET comprising a gate and a drain connected to a gate of the third P-channel MOSFET, a source to which the power supply voltage is applied, and the drain connected to a drain of the second N-channel MOSFET, wherein the first and second N-channel MOSFETs, which are commonly connected, have a differential amplification circuit configuration connected to a ground.

11. The circuit of claim 10, wherein the reference resistor circuit further comprises an output resistor between the drain of the first N-channel MOSFET and the drain of the third P-channel MOSFET.

12. The circuit of claim 11, wherein the current mirror circuit comprises:

a fifth P-channel MOSFET comprising a gate connected to a connection node between the drain of the third P-channel MOSFET and the output resistor, and a source connected to a power supply voltage terminal;

a sixth P-channel MOSFET comprising a gate connected to a gate of the fifth P-channel MOSFET, and a source connected to the power supply voltage terminal;

a seventh P-channel MOSFET comprising a gate connected to a connection node between the drain of the first N-channel MOSFET and the output resistor, a source connected to a drain of the fifth P-channel MOSFET, and a drain connected to the gate of the second N-channel MOSFET; and an eighth P-channel MOSFET comprising a gate connected to a gate of the seventh P-channel MOSFET, a source connected to a drain of the sixth P-channel, and a drain through which the mirror current corresponding to the reference current is output.

13. The circuit of claim 10, further comprising a power control circuit that comprises:

a ninth P-channel MOSFET comprising a gate receiving a control signal, and a drain connected to the drain of the third P-channel MOSFET; and a tenth P-channel MOSFET comprising a gate receiving the control signal, a source through which the power supply voltage is applied, and a drain connected to the drain of the fourth P-channel MOSFET, wherein the power control circuit determines activation/deactivation of an operation according to a logic level of the control signal.

14. The circuit of claim 10, wherein the current mirror circuit comprises:

an eleventh P-channel MOSFET comprising a gate connected to the drain of the first N-channel MOSFET, a source connected to a power supply voltage terminal, and a drain connected to the gate of the second N-channel MOSFET; and a twelfth P-channel MOSFET comprising a gate connected to a gate of the eleventh P-channel MOSFET, a source connected to the power supply voltage terminal, and a drain through which the mirror current corresponding to the reference current is output.

15. The circuit of claim 10, further comprising a stabilization circuit that comprises:

a first capacitor connected between a power supply voltage terminal and the drain of the first N-channel MOSFET; and a resistor and a second capacitor connected in series between the drain of the first N-channel MOSFET and the gate of the second N-channel MOSFET.

* * * * *